US006354860B1

(12) United States Patent
Miller et al.

(10) Patent No.: US 6,354,860 B1
(45) Date of Patent: Mar. 12, 2002

(54) CONNECTOR AND CONNECTOR ASSEMBLY

(75) Inventors: Timothy J. Miller; Randolph S. Golab, both of Warren, PA (US); Matthew J. Hoff, Jamestown, NY (US); Michael J. Roche, Dearborn, MI (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/430,876

(22) Filed: Nov. 1, 1999

(51) Int. Cl.[7] ..... H01R 13/627
(52) U.S. Cl. ..... 439/352; 439/489
(58) Field of Search ..... 439/350–358, 439/488, 489

(56) References Cited

U.S. PATENT DOCUMENTS 5,720,623 A * 2/1998 Polenick et al. ..... 439/352
5,775,930 A * 7/1998 Model et al. ..... 439/352
5,807,130 A * 9/1998 Miller et al. ..... 439/352
6,004,153 A * 12/1999 Myer et al. ..... 439/352
6,068,507 A * 5/2000 Popa ..... 439/352
6,077,101 A * 6/2000 Garretson et al. ..... 439/352
6,126,480 A * 10/2000 Kawase et al. ..... 439/352

* cited by examiner

*Primary Examiner*—Hien Vu
(74) *Attorney, Agent, or Firm*—William H. McNeill

(57) ABSTRACT

A connector is provided that includes a first housing having a see-saw first latch element attached thereto. The first housing and first latch element are adapted for engagement with a mating second housing that includes a mating second latch element, respectively. A slider is provided that includes a hood, having a window, and a beam the distal end of that is engagable with the first latch element to prevent movement of the slider further towards the first latch element until the distal end is engaged by the second latch element. When the second latch element engages the distal end of the beam, the distal end is pivoted into the window of the hood. The slider may be moved so that the distal end resides into engagement with the second latch element only after the first and second latch elements have been fully engaged. When the distal end has been so positioned, the beam will prevent disengagement of the first and second latch elements.

10 Claims, 5 Drawing Sheets

CONNECTOR AND CONNECTOR ASSEMBLY

TECHNICAL FIELD

The present invention relates to a connector that is adapted for connection to a mating connector by a see-saw latch element that is adapted to be engaged by a mating latch element. A slider is provided that includes a beam that is pivoted vertically into a window provided in a hood to actuate a secondary locking system that prevents disengagement of the latch element and mating latch element.

BACKGROUND ART

It is known to provide connectors that may be mechanically connected together but that can not be readily disconnected. For example, it is known to provide two mating electrical connectors comprising male and female contacts therein, respectively, the connectors and the contacts being connected together to form a connector assembly. Disconnection may be provided by means of a connector position assurance (CPA) member. However, in some instances a connector assembly of this type may be readily disconnected.

It is known to provide mating connectors that are latched together by a see-saw type latch element of one connector that engages a mating latch element of the other connector. In such devices it is known to provide a secondary lock to assure that the mated connectors do not become unlatched. It is known to provide the secondary lock in the form of a rear loaded slider that either (a) prevents depression of the see-saw at the rear position thereof designed for depression by the user to unlock the secondary lock, or (b) prevents the raising of the see-saw at the front position thereof designed to be raised when the rear position is depressed to unlock the secondary lock. Such secondary locks are typically designed to be retained by one of the connectors prior to complete engagement with the mating connector. Typically the secondary lock can not be actuated prior to complete engagement of the two connectors, and the fully engaged connectors can not be disengaged without deactuating the secondary lock. A disadvantage of some known connectors and connector assemblies having such secondary locks is that such devices tend to be rather complicated that requires that they be larger than desired for some applications. For example, in some devices, the secondary lock must be deflected vertically, and such vertical deflection requires sufficient height to provide the necessary clearance. Another disadvantage of some known connectors and connector assemblies is that in those applications wherein the secondary lock comprises a locking arm, there has been a tendency for the tip of the arm to be stubbed during actuation thereof. A further disadvantage of some known connectors and connector assemblies is that multiple features must be overcome to engage the secondary lock. This results in an engagement profile that tends to be rough.

DISCLOSURE OF THE INVENTION

It is an object of the present invention to provide an improved connector.

Another object of the present invention is to obviate the disadvantages of the prior art by providing an improved connector.

Yet another object of the present invention is to provide an improved connector that is difficult, if possible, to disengage from a mating connector.

A further object of the present invention is to provide a connector that does not include complicated engagement features.

It is still another object of the present invention to provide a connector having features that allow a reduction in size.

Another object of the present invention is to provide a connector comprising a secondary lock that has reduced vertical clearance requirements and therefore can be fabricated having a corresponding height reduction.

A further object of the present invention is to provide a connector incurring reduced stubbing during use.

Another object of the present invention is to provide a connector having only a single feature that must be overcome to engage the secondary lock.

Yet a further object of the present invention is to provide a connector assembly that achieves one or more of the foregoing objects.

This invention achieves these and other objects by providing a connector that comprises a housing extending in a direction of a longitudinal axis from a front end to a rear end, the housing being structured and arranged for connection to a mating connector in a mating mode. A see-saw latch element is attached to the housing and extends in such direction from a first end to a second end, the latch element being structured and arranged for engagement with a mating latch element of the mating connector in the mating mode. A slider is slidably mounted relative to the latch element and the housing in such direction from the rear end for sliding in such direction towards the front end. The slider comprises a body portion, and a cantilevered beam extending in such direction from the body portion towards the front end to a distal end segment. The distal end segment is structured and arranged (a) for abutment with a first segment of the latch element to prevent movement of the slider in such direction towards the front end; (b) for being pivoted away from the axis by the mating latch element, as the mating latch element engages the latch element in the mating mode, to permit sliding of the slider towards the front end; and (c) then residing towards such axis and into abutment with a second segment of the latch element in the mating mode such that the beam prevents disengagement of the latch element from the mating latch element of the second housing. The body portion further comprises a first hood, the first hood comprising a window aligned with the distal end segment and structured and arranged for receiving the distal end segment therein when the distal end segment is pivoted away from such axis.

BRIEF DESCRIPTION OF THE DRAWINGS

This invention may be clearly understood by reference to the attached drawings in that like reference numerals designate like parts and in that.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1A:
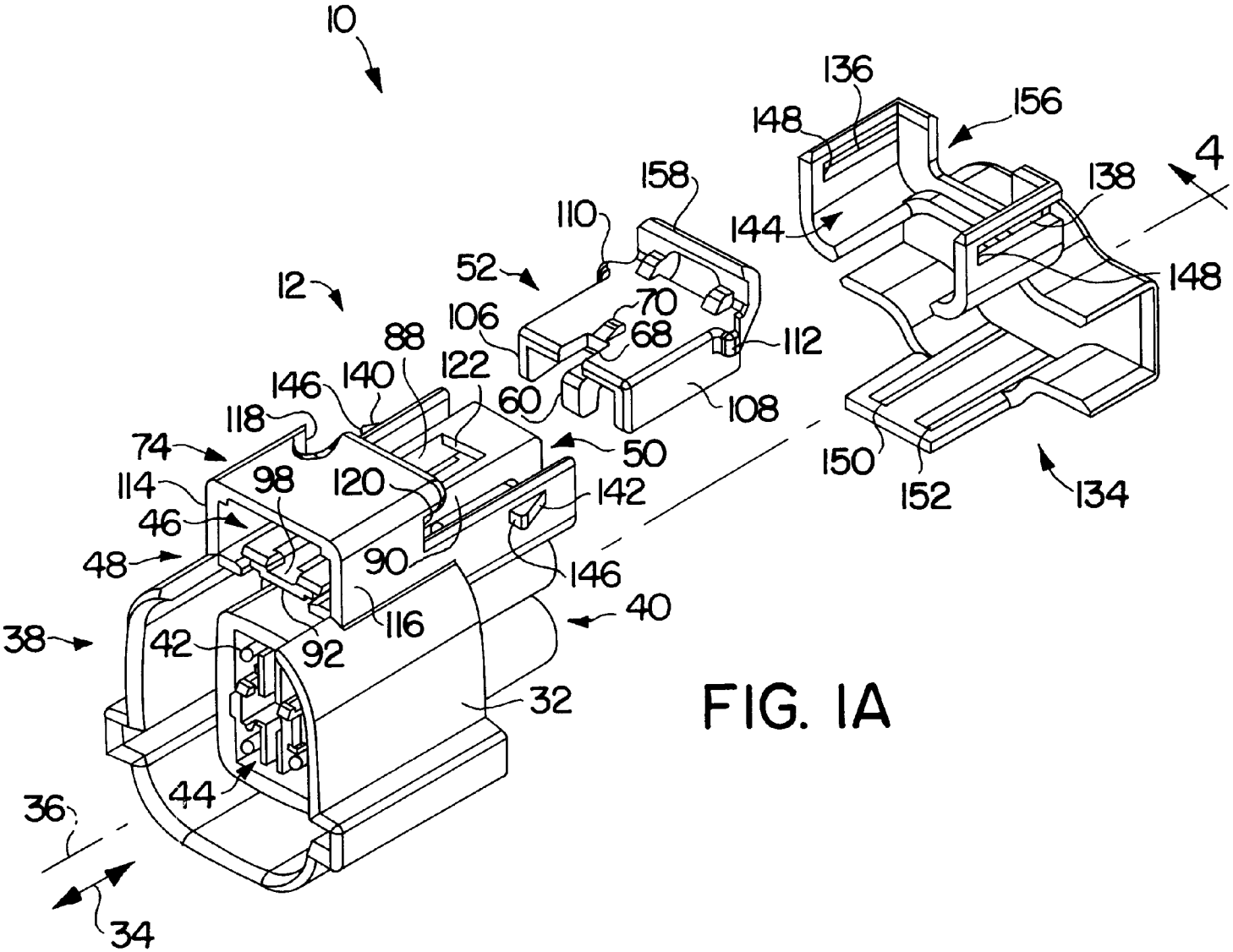
FIGS. 1A and 1B illustrate an exploded view of the connector assembly of the present invention.
Figure 1B:
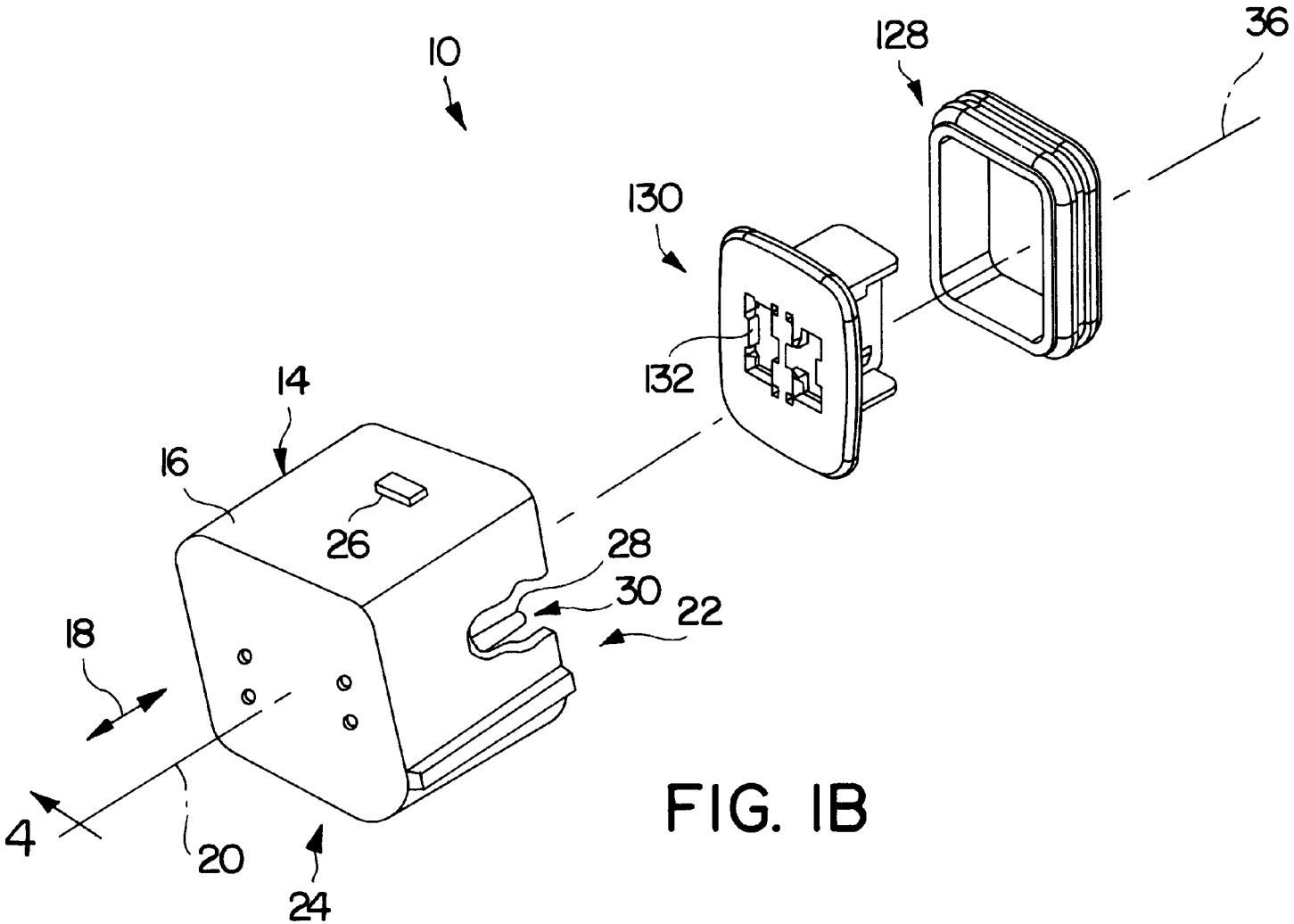

Referring to the drawings, FIGS. 1A and 1B illustrate a connector assembly 10 that comprises a first connector 12 and a mating second connector 14. Connectors 12 and 14 may be structured and arranged to contain female and male contacts, respectively, in a conventional manner. Alternatively, connector 12 could contain male contacts and connector 14 could contain female contacts, if desired. The male and female contacts may be connected to conductors and/or other contacts or circuits depending upon the intended use thereof.

In the embodiment illustrated in FIG. 1B, connector 14 comprises a housing 16 that extends in direction 18 of a longitudinal axis 20 from a forward end 22 to a rearward end 24. Housing 16 may be fabricated from a plastic material in a conventional manner. Housing 16 comprises a latch element 26. Contacts 28 are disposed within respective openings 30 of housing 16. By way of example, each contact 28 may be in the form of a typical male contact formed by a prong in a conventional manner.

With reference to FIG. 1A, the connector 12 comprises a housing 32 that extends in the direction 34 of a longitudinal axis 36 from a front end 38 to a rear end 40. Housing 32 may be fabricated from a plastic material in a conventional manner. Contacts 42 are disposed within respective openings 44 of housing 32. Each contact 42 may be in the form of a typical female contact formed by a ferrule in a conventional manner. The housing 32 is structured and arranged for connection to the connector 14 in a mating mode, as described hereinafter. Respective contacts 28 and 42 are structured and arranged for electrical connection to each other in the mating mode, in a conventional manner.

A see-saw latch element 46 is attached to housing 32. Latch element 46 extends in direction 34 from a first end 48 to an opposite second end 50. The see-saw latch element 46 is structured and arranged for engagement with the mating latch element 26 of the connector 14 in the mating mode to lock the connectors 12 and 14 together as described hereinafter.

Figure 2:
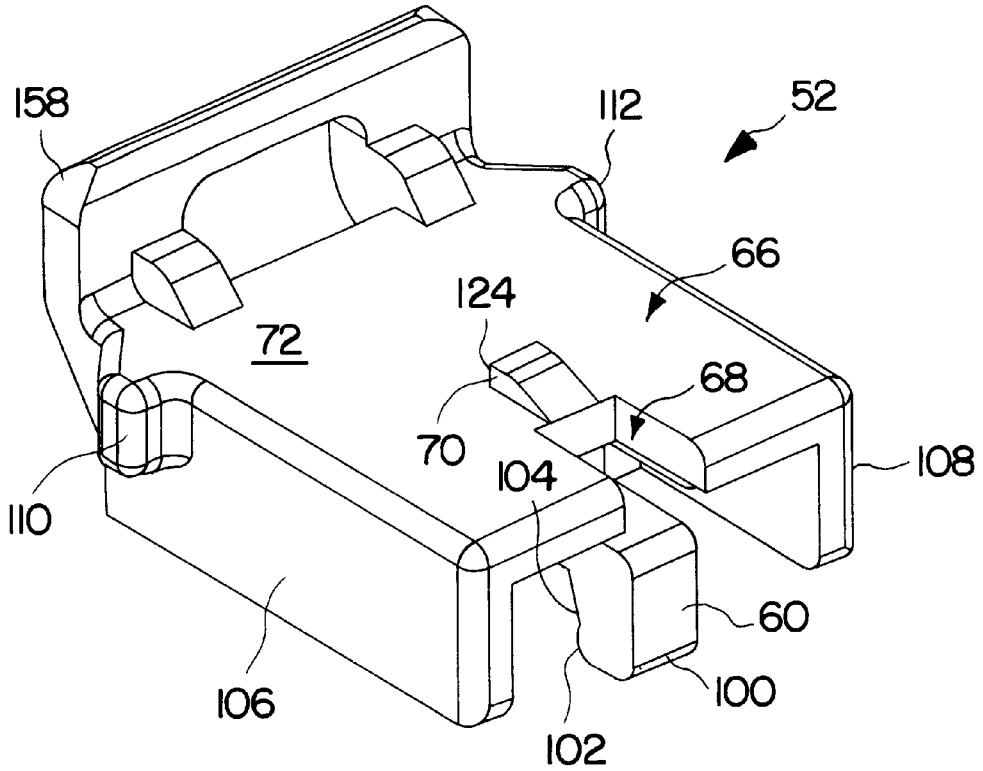
FIG. 2 is a perspective top view of the slider of the embodiment of the present invention illustrated in FIG. 1A.
Figure 3:
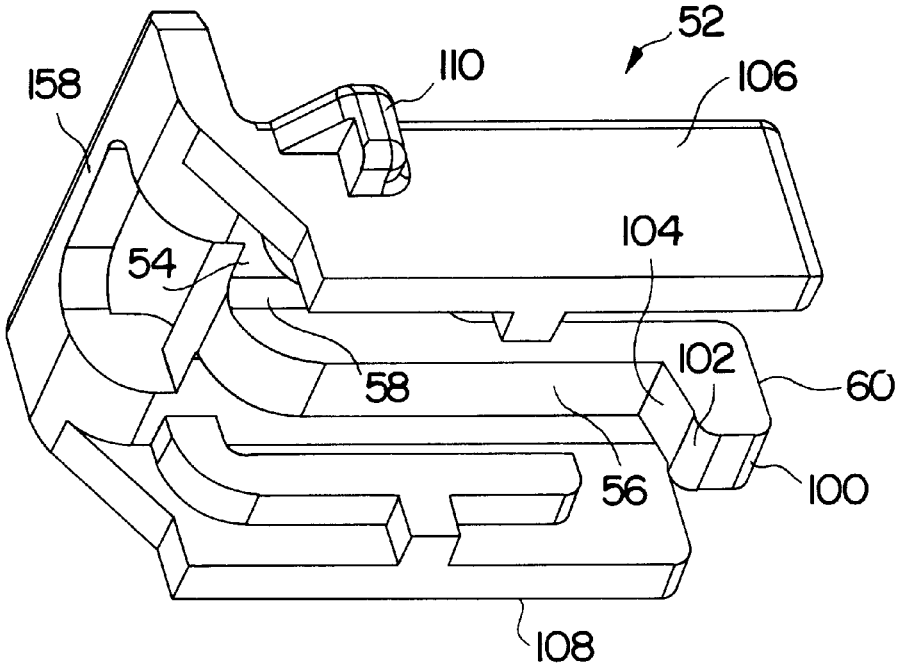
FIG. 3 is a perspective bottom view of the slider illustrated in FIG. 2.
Figure 4:
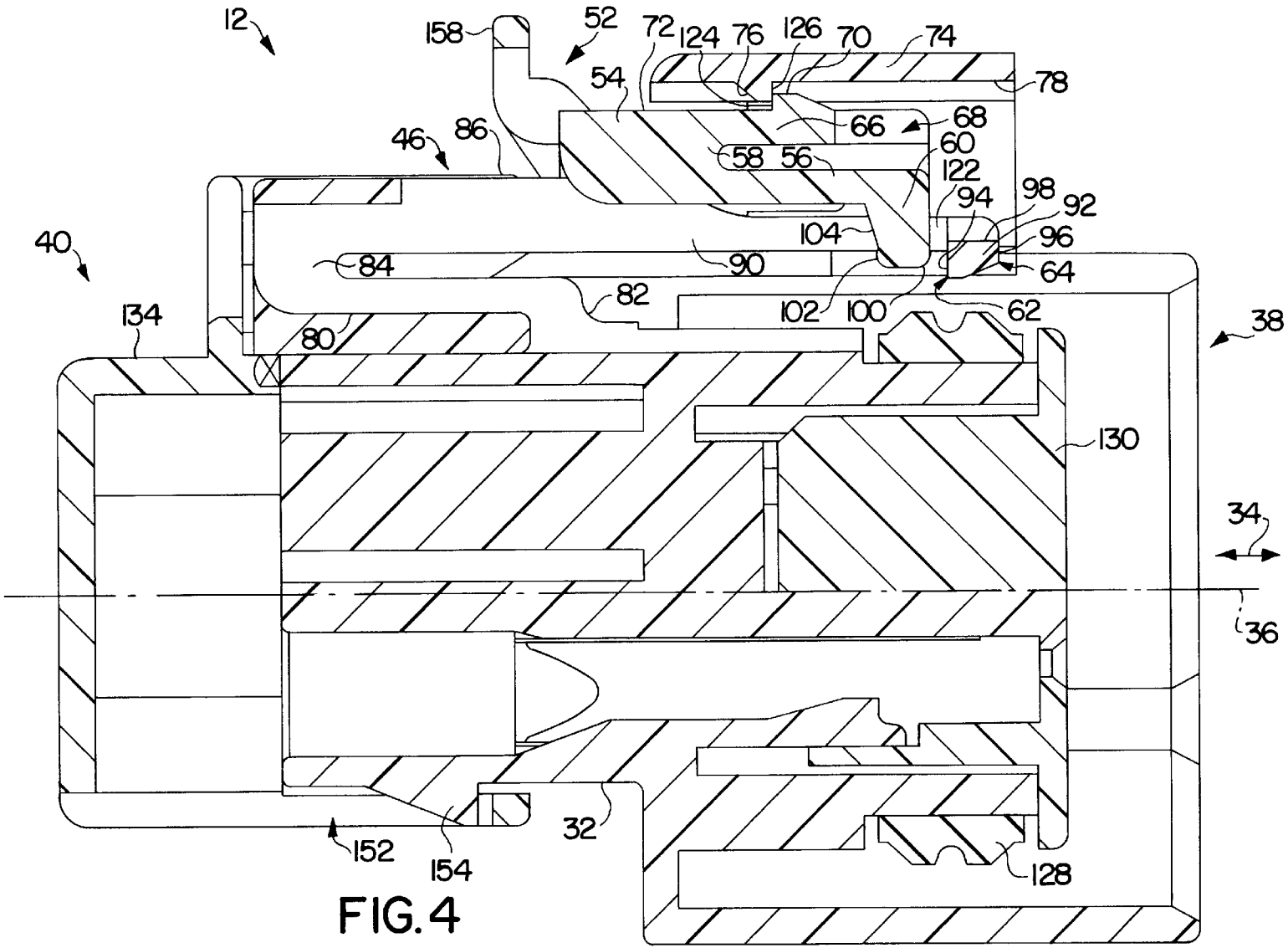
FIG. 4 is a view of FIGS. 1A and 1B taken along lines 4—4.

A slider 52 is mounted relative to the see-saw latch element 46 and housing 32 from the rear end 40 for sliding in direction 34 towards front end 38. With reference to FIGS. 2, 3 and 4, the slider 52 comprises a body portion 54 and a cantilevered beam 56 that extends in direction 34 from the body portion at 58 towards the front end 38 to a distal end segment 60. The distal end segment 60 is structured and arranged for abutment with a first segment 62 of the latch element 46 to prevent movement of the slider 52 in direction 34 towards front end 38, as described hereinafter. The distal end segment 60 is further structured and arranged for (a) being pivoted away from axis 36 by the mating latch element 26 to permit sliding of the slider 52 towards the front end 38, and (b) then residing towards axis 36 adjacent to a second segment 64 of the latch element 46 in the mating mode such that beam 56 prevents disengagement of the latch element from the mating latch element, as described hereinafter. The body portion 54 also includes a hood 66. The hood 66 includes a window 68 aligned with the distal end segment 60. The window 68 is structured and arranged for receiving the distal end segment 60 therein when the distal end segment is pivoted away from axis 36.

The hood 66 comprises a latching element 70 extending from an outer surface 72 of the hood 66. Housing 32 comprises a hood 74 disposed above hood 66. Hood 74 is also disposed above the first segment 62 and second segment 64 of the end 48 of the see-saw latch element 46. Hood 74 comprises a latching element 76 extending from an inner surface 78 of hood 74. Latching elements 70 and 76 are engagable with each other as described hereinafter to prevent sliding of the slider 52, in direction 34 towards the rear end 40, and removal of the slider from the housing 32 and latch element 46.

The latch element 46 comprises a first length 80 cantilevered from a pivot base 82 towards the rear end 40 to an end portion 84. Latch element 46 further comprises a second length 86 cantilevered from end portion 84 towards the front end 38 to the first and second segments 62, 64. The second length 86 comprises a first arm 88 and a second arm 90 spaced from first arm 88, each of that extends in direction 34 towards the front end 38 to a bridging element 92 that connects arms 88 and 90. The bridging element 92 comprises the first segment 62 and the second segment 64. Segment 62 comprises a first surface 94 facing the rear end 40, and the segment 64 comprises a second surface 96 facing the first end 38. The segments 62 and 64 are joined by an upper bridging surface 98.

The distal end segment 60 of the slider 52 comprises a leading edge that comprises a first convex surface 100 and a trailing edge comprising a second convex surface 102. Distal end segment 60 also comprises a recess 104 adjacent the convex surface 102. The first surface 94 is engagable with the recess 104 in the mating mode.

In the embodiment illustrated in FIG. 1A, the slider 52 comprises a first side 106 and opposite second side 108 extending in the direction 34. A first protrusion 110 extends away from an outer surface of the first side 106, and a second protrusion 112 extends away from an outer surface of the second side 108. The first and second protrusions 110 and 112 are structured and arranged to abut the hood 74 in the mating mode. For example, in the embodiment illustrated in FIG. 1A, the hood 74 comprises a first wall 114 and an opposite second wall. Wall 114 and 116 extend in direction 34 adjacent respective sides 106 and 108 of the slider 52, respectively. Wall 114 comprises a first indentation 118 and wall 116 comprises a second indentation 120. Protrusion 110 and 112 extend into indentation 118 and 120 against walls 114 and 116, respectively, in the mating mode.

The connector 12 will typically be put into use with the slider 52 attached relative to the seesaw latch element 46 and housing 32 as illustrated in FIG. 4. To this end, the slider is slid in direction 34 towards the front end 38 with the sides 106 and 108 disposed between the walls 114 and 116, respectively, until the distal end segment 60 engages the surface 94 of the first segment 62 and is prevented from moving further towards the front end. The beam 56 and distal end segment 60 will be disposed within the opening 122 between the arms 88 and 90. As the slider 52 is caused to slide towards front end 38, the latching element 70 engages, and snaps into place relative to, the latching element 76 such that an abutment surface 124 of the latching element 70 will engage an abutment surface 126 of latching element 76. Such engagement will prevent the slider 52 from being removed from the housing 32 by preventing movement of the slider towards the rear end 40.

Figure 5A:
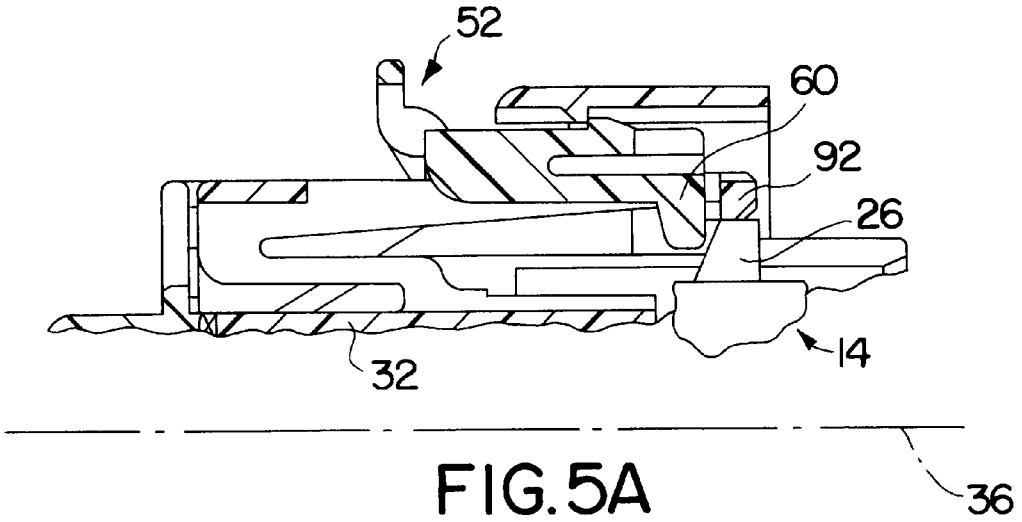
FIGS. 5A to 5C are diagrammatic representations illustrating use of the connector assembly illustrated in FIGS. 1A and 1B.
Figure 5B:
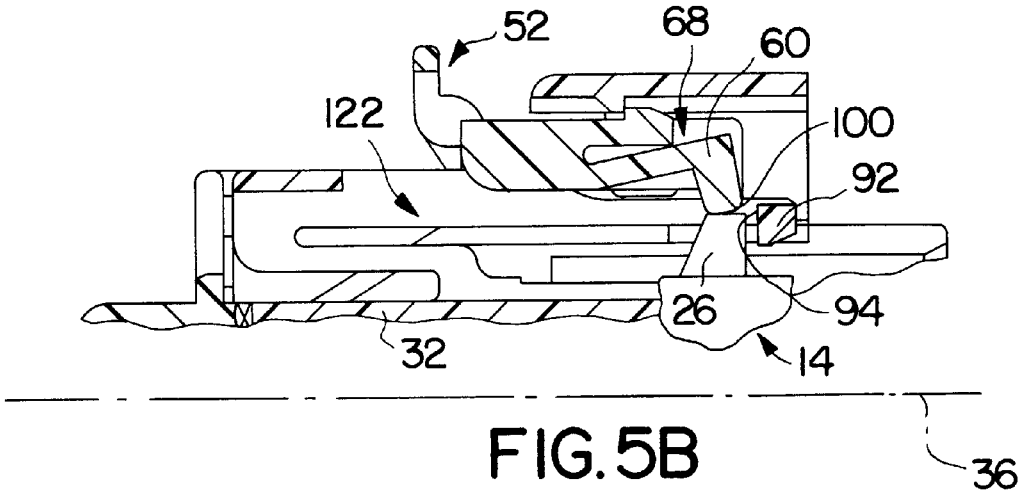
Figure 5C:
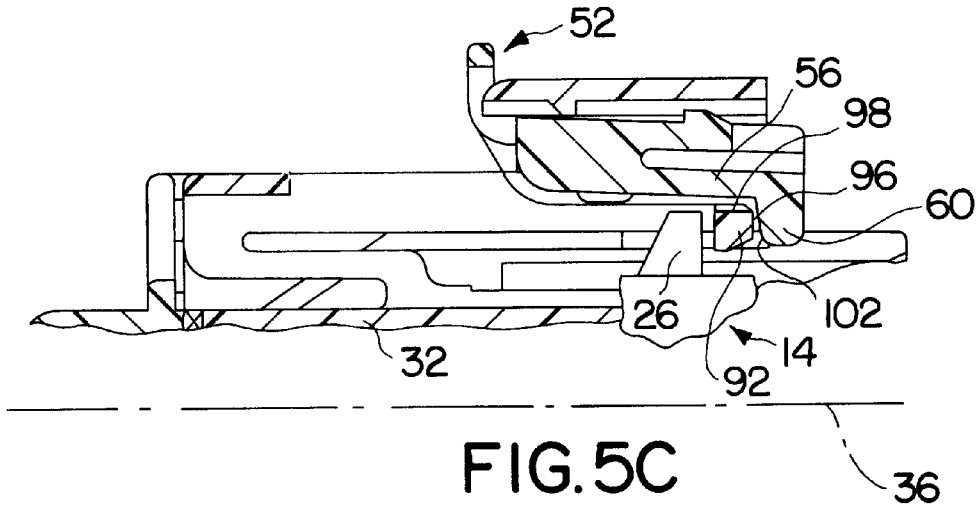

With reference to FIGS. 1A, 1B and 4, assembly of the connector 12 may be completed by inserting a gasket 128 into the front end 38 of connector 12 and enclosing the front end with a front cover 130. Cover 130 includes openings 132 that are in alignment with openings 44. A rear cover 134 may also be attached at the rear end 40 of the housing 32. To this end, cover 134 comprises elongated openings 136 and 138 into that protrusions 140 and 142 may be snapped by sliding the rear end 40 of the housing 32 into the cavity 144 of the cover such that respective surfaces 146 engage respective surfaces 148. Openings 150 and 152 are also provided that mate with corresponding protrusions 154 extending from the bottom of the housing 32. The elongated openings 136, 138 and 150, 152 are structured and arranged such that the rear cover 134 can be moved in direction 36 towards the front 38 when the slider 52 is moved in such direction. The opening 156 provides ready access to a slider actuating surface 158 of the slider. When fully assembled the housing 14 may be inserted into housing 12 in direction 34 of axis 36 causing the contacts 28 and 42 to be connected in a conventional manner. With reference to FIG. 5A, during such insertion, the latch element 26 will engage bridging element 92 thereby pivoting it away from axis 36. With reference to FIG. 5B, continued insertion causes the latch element 26 to engage and slide relative to the convex surface 100 and urge the distal end segment 60 away from axis 36 and into the window 68 as the latch element 26 disengages the bridging element 92 thereby allowing it to resile towards axis 36. In this manner, the latch element 26 will extend into opening 122 adjacent surface 94 of the segment 62, such engagement preventing the pulling apart of the connectors 12 and 14. With reference to FIG. 5C, continued insertion causes the convex surface 102 to engage the surface 96 of the segment 64 as the distal end segment 60 disengages the surface 98 and resides towards axis 36 until the surface 96 is adjacent to the recess 104. At this point, the beam 56 extends above the bridging surface 98 and prevents movement of the bridging element 92 away from axis 36 thereby preventing the disengagement of the latch elements 26 and 46.

It should be noted that the positioning of the distal end segment 60 below the hood 74 makes it very difficult, if possible, to reposition the distal end segment in such a manner as to allow disengagement of the latch elements 26 and 46. It should further be noted that the connector 12 does not include complicated engagement features. For example, the attachment of the slider 52 to the hood 74 only requires mating latching elements 70 and 76. The limitation of movement of the slider until the distal end segment 60 is engaged by the latch element 14 merely requires that the distal end segment abut the bridging element 92. Further, the actuation of the secondary lock merely requires that the latch element 26 cause the distal end segment 60 to be pivoted into window 68. Use of the window feature permits a reduction in the size of the connector 12 by reducing the vertical clearance requirement of the distal end segment 60. Such reduction in size permits a corresponding reduction in the size of the mating connector 14. The engagement profile will have a smoother feel since only the locking feature retains the secondary lock from engagement; that is, all that prevents actuation of the secondary lock is the distal end segment 60 bearing against the latch element 46. The smoothness of the engagement profile is further facilitated by the convex surfaces 100 and 102 that also serve to prevent stubbing of the distal engagement end 60 when the connectors 12 and 14 are connected together.

The embodiments that have been described herein are but some of several that utilize this invention and are set forth here by way of illustration but not of limitation. It is apparent that many other embodiments that will be readily apparent to those skilled in the art may be made without departing materially from the spirit and scope of this invention.

What is claimed is:

1. An electrical connector, comprising:

a housing extending in a direction of a longitudial axis from a front end to a rear end and having a contact therein, said housing being structured and arranged for connection to a mating connector in a mating mode;

a rear cover for covering said rear end of said housing;

a see-saw latch element attached to said housing and extending in said direction from a first end to a second end, said latch element being structured and arranged for engagement with a mating latch element of said mating connector in said mating mode;

a slider slidably mounted relative to said latch element and said housing from said rear end for sliding in said direction towards said front end, said slider comprising a body portion and a cantilevered beam extending in said direction from said body portion towards said font end to a distal end segment, said distal end segment being structured and arranged (a) for abutment with a first segment of said latch element to prevent movement of said slider in said first direction towards said front end; (b) for being pivoted away from said axis by said mating latch element, as said mating latch element engages said latch element in said mating mode, to permit sliding of said slider towards said front end; and (c) then residing towards said axis adjacent a second segment of said latch element such that said beam prevents disengagement of said latch element from said mating latch element of said second housing, said body portion further comprising a first hood, said first hood comprising a window aligned with said distal end segment and structured and arranged for receiving said distal end segment therein when said distal end segment is pivoted away from said axis.

2. The connector of claim 1 wherein said housing comprises a second hood disposed above said first hood, and disposed above said first segment and said second segment of said latch element.

3. The connector of claim 2 wherein said first hood comprises a first latching element extending from an outer surface of said first hood, and said second hood comprises a second latching element extending from an inner surface of said second hood, said first latching element being engagable with said second latching element to prevent sliding of said slider, in said first direction towards said rear end, and removal of said slider from said first housing.

4. The connector of claim 3 wherein said latch element comprises a first length cantilevered from a pivot base towards said rear end to an end portion, and a second length cantilevered from said end portion towards said front end to said first segment and said second segment.

5. The connector of claim 4 wherein said second length comprises a first arm, and a second arm spaced from said first arm, extending in said direction towards said front end to a bridging element connecting said first arm to said second arm, said bridging element comprising said first segment and said second segment that comprise, respectively, a first surface facing said rear end and an opposite second surface facing said front end, said bridging element further comprising an upper bridging surface joining said first segment and said second segment.

6. The connector of claim 5 wherein said distal end segment comprises a leading edge comprising a first convex surface structured and arranged for engagement with, and sliding relative to, said mating latch element when said distal end segment is being pivoted away from said axis.

7. The connector of claim 6 wherein said distal end segment comprises a trailing edge comprising a second convex surface structured and arranged for engagement with, and sliding relative to, said second surface when said distal end segment is residing towards said axis.

8. The connector of claim 7 wherein said distal end segment comprises a recess adjacent said second convex surface, said first surface being engagable with said recess when said distal end segment resides towards said axis.

9. The connector of claim 8 wherein said first hood further comprises a first side and an opposite second side extending in said first direction, a first protrusion extending away from an outer surface of said first side, and a second protrusion extending away from an outer surface of said second side, said first protrusion and said second protrusion being structured and arranged to abut against said second hood in said mating mode.

10. The connector of claim 9 wherein said second hood comprises a first wall and an opposite second wall extending in said first direction adjacent said first side and said second side, respectively, said first wall comprising a first indentation and said second wall comprising a second indentation, said first protrusion and said second protrusion extending into said first indentation and said second indentation in said mating mode.

* * * * *